United States Patent [19]

Sawazaki

[11] Patent Number: 4,457,144

[45] Date of Patent: Jul. 3, 1984

[54] YARN FEEDING APPARATUS FOR CIRCULAR KNITTING MACHINES

[75] Inventor: Masatoshi Sawazaki, Kobe, Japan

[73] Assignee: Precision Fukuhara Works, Ltd., Kobe, Japan

[21] Appl. No.: 303,633

[22] Filed: Sep. 18, 1981

[30] Foreign Application Priority Data

Feb. 17, 1981 [JP] Japan ..... 56-21770

[51] Int. Cl.[3] ..... D04B 15/48

[52] U.S. Cl. ..... 66/132 T

[58] Field of Search ..... 66/125 R, 132 R, 132 T; 242/47.01

[56] References Cited

U.S. PATENT DOCUMENTS

| | | | |
|---|---|---|---|
| 2,744,399 | 5/1956 | West | 66/132 R |
| 3,361,317 | 1/1968 | Levin | 66/132 T X |
| 3,418,831 | 12/1968 | Nance | 66/132 T |
| 3,491,963 | 1/1970 | Schlumpf | 242/47.01 |
| 3,709,444 | 1/1973 | Tannert | 66/132 T X |
| 4,004,438 | 1/1977 | Raisin | 66/132 R |
| 4,199,965 | 4/1980 | Wilson | 66/125 R |

FOREIGN PATENT DOCUMENTS

| | | | |
|---|---|---|---|
| 1521119 | 3/1968 | France | 66/132 T |
| 2112833 | 5/1972 | France | 66/132 R |
| 2141482 | 1/1973 | France | 66/132 R |
| 72097 | 4/1970 | German Democratic Rep. | 66/132 T |
| 2035389 | 6/1980 | United Kingdom | 66/132 T |

*Primary Examiner*—Wm. Carter Reynolds
*Attorney, Agent, or Firm*—Nathan Levin

[57] ABSTRACT

Self actuated positive yarn feeding apparatus for use with circular knitting machines for the positive feeding of yarns to the machines in response to and for the time that a demand for yarn is created by the knitting action of the needles of the machines, and wherein feeding of the yarn is discontinued in response to a lack of demand for yarn by the machines. Wheels having adjacent horizontally extending circumferential zones of high and of low friction surfaces are provided wherein only the high friction surfaces feed the yarn. A movable pair of yarn guiding eyelets is positioned between a fixed pair of yarn guiding eyelets and the wheel with the yarn threaded, in turn, through a fixed eyelet, then through a movable eyelet, then around the wheel, then through the other movable eyelet, and finally through the other fixed eyelet. The movable eyelets acts to shift the yarn between the high and the low friction surfaces in response to demand for yarn by the machines. The apparatus can be used on machines having yarn changer boxes, needle selecting means, or other devices needing non-uniform yarn feeding, as well as on machines needing uniform yarn feeding.

1 Claim, 7 Drawing Figures

Figure 1:
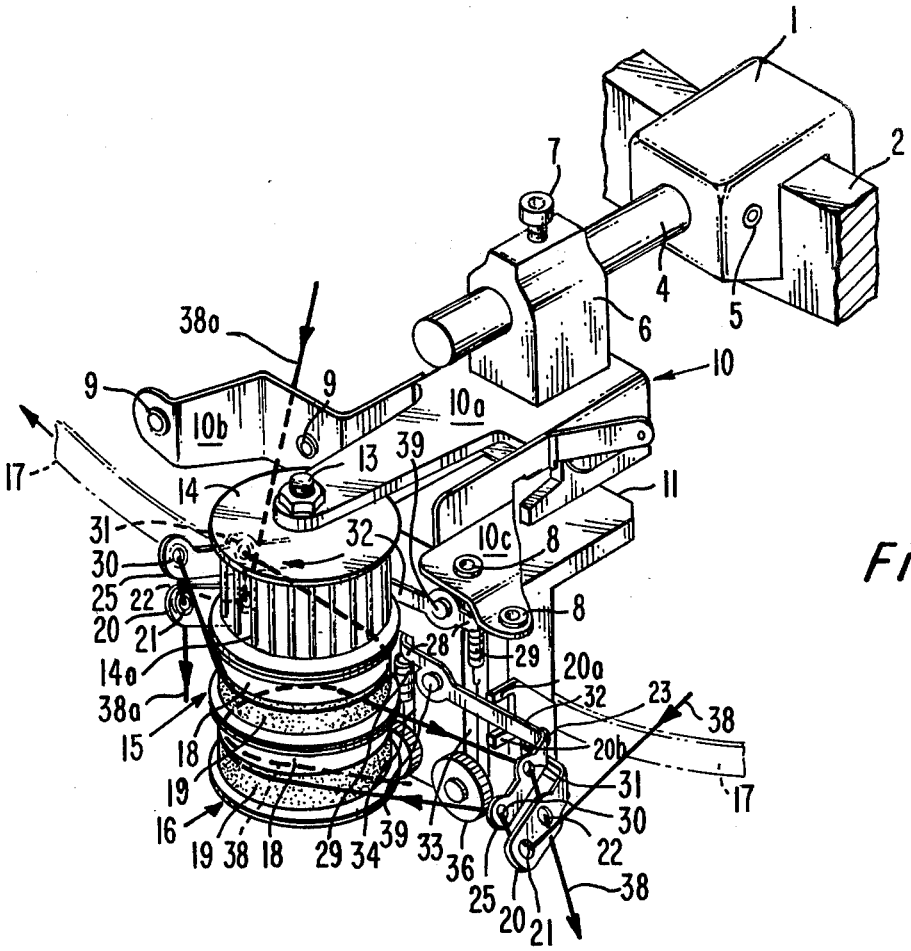

Fig.5
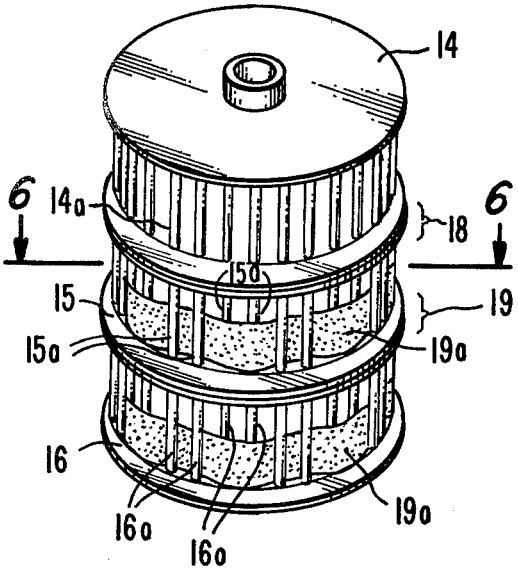
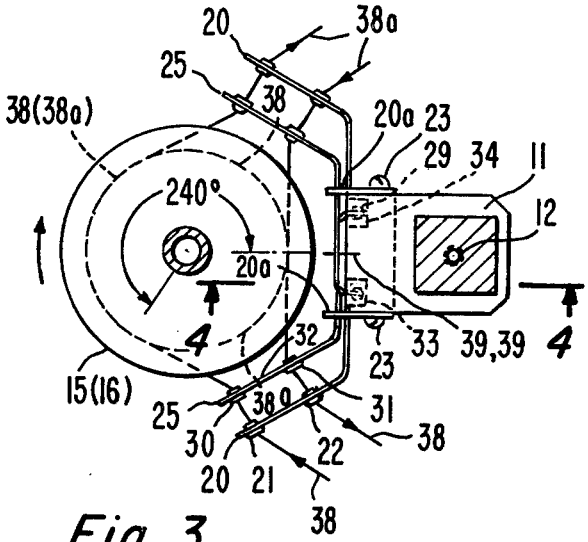
Fig.3.
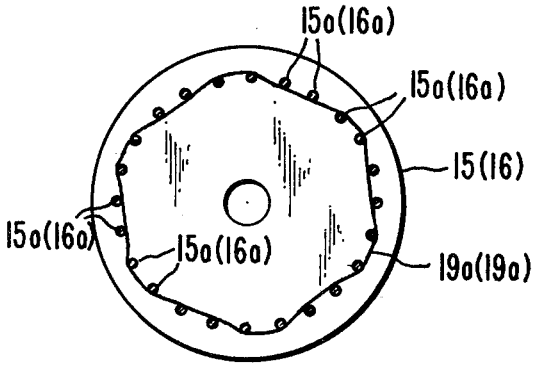
Fig.6.
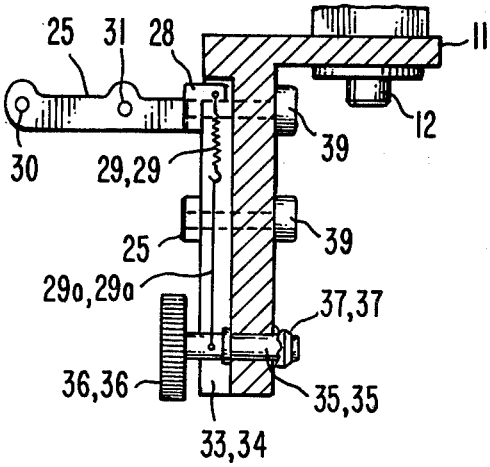
Fig.4.
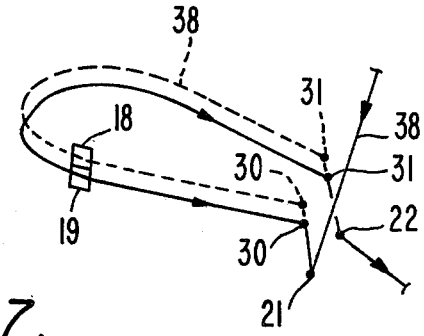
Fig.7.

YARN FEEDING APPARATUS FOR CIRCULAR KNITTING MACHINES

The present invention relates generally to the art of knitting and more particularly to an improvement in self actuated positive yarn feeding means as used with circular knitting machines for the positive feeding of yarns to the machines in response to and for the time that a demand or call for yarn is made by the knitting action of the needles of the machine.

Knitted fabric, of plain or stripe or of pattern formation, is generally of superior quality when the yarns making the same are fed in a positive manner at a desired rate of feed to the machine making the fabric.

All of the needles knit the yarns when making plain fabric on multi-feed machines with the result that a continuous demand for yarn is created at each feed of the machine. Positive feeding of the yarns to supply this demand at a desired rate of feed may be made by the apparatus shown in the Rosen U.S. Pat. Nos. 3,090,215 and 3,243,091 wherein an endless tape driven at an adjustable speed is trained over and rotates each of a circularly spaced series of vertically extending feed wheels or rollers and wherein yarns placed between the tape and the periphery of the feed wheels are positively fed to the machine.

The same continuous demand for yarn continues when making striped fabric, however, the newly active yarn to form the stripe is now to be positively fed while the feeding of the idled yarn is discontinued. Apparatus to positively feed the newly active yarn and at the same time to discontinue the feeding of the idled yarn is shown in the Nance U.S. Pat. No. 3,418,831 wherein pattern controlled means moves the yarn axially of the feed wheels into and out of driven contact with the driving tape.

Other apparatus to provide similar control of the yarns when making striped fabric is shown in the Scotto di Carlo U.S. Pat. No. 3,950,966 wherein a pivotally mounted bracket is moved to shift the yarn axially of the feed wheel into and out of driven contact with the tape, and wherein the bracket is so moved in response to demand and lack of demand for yarn by the knitting action of the machine. The backet (37) has spaced yarn guiding eyelets (36, 44) fixed thereto and is pivoted at a point (33) between the eyelets so that the latter moves in opposite directions about the pivot point when the bracket is rocked. The bracket is balanced so that gravity turns it to idle position when there is no demand for yarn so that the eyelets shift the yarn downwardly away from and out of contact with the tape to non-feeding position. The balance of the bracket is also such that it is turned to active position by the yarn itself when there is demand for the same so that the eyelets shift the yarn upwardly toward and into contact with the tape into feeding position. The bracket and its eyelets are on the outlet side of the wheel and tape. The geometry of the arrangement is such that shifting of the yarn between feeding and non-feeding positions is undesirably sluggish and is unsatisfactory when quick changes in positive yarns feeding are desired.

It is the principal object of the present invention to provide an improvement in self actuated positive yarn feeding apparatus for the positive feeding of yarns to circular knitting machines in response to and for the time that a demand for the yarns is made by the knitting action of the needles of the machines, and wherein the apparatus is more sensitive to and responds quicker to changes in demand for yarn by the needles of the machine. The present apparatus also responds to intermittent demands for the same yarn during the knitting of pattern fabric wherein it is only the needles knitting the pattern yarn which create the demand for yarn.

It is an object of the invention to use yarn feeding wheels wherein the periphery of the wheels have axially abutting circumferentially extending zones of relatively low and relatively high friction surfaces, wherein the yarns encircle the wheels, and wherein the yarns are shifted between the zones so as to be driven by the high friction surface and so as not to be driven by the low friction surface.

It is also an object of the invention to provide a spaced pair of movable yarn guiding eyelets between the wheel and a spaced pair of fixed yarn guiding eyelets, wherein the yarn extends from its source through one of the fixed eyelets, then through one of the movable eyelets, then encircles the wheel, then extends through the other of the movable eyelets, then through the other of the fixed eyelets, and then to the machine, and wherein movements of the movable eyelets in response to the demand and lack of demand for yarn causes the yarn to move between the zones on the wheel.

With the above and other objects in view as will become apparentfrom the accompanying drawings and the description thereof, the invention resides in the improvement in the yarn feeding apparatus for circular knitting machines as shown and as described, and as set forth in the appended claims.

Figure 2:
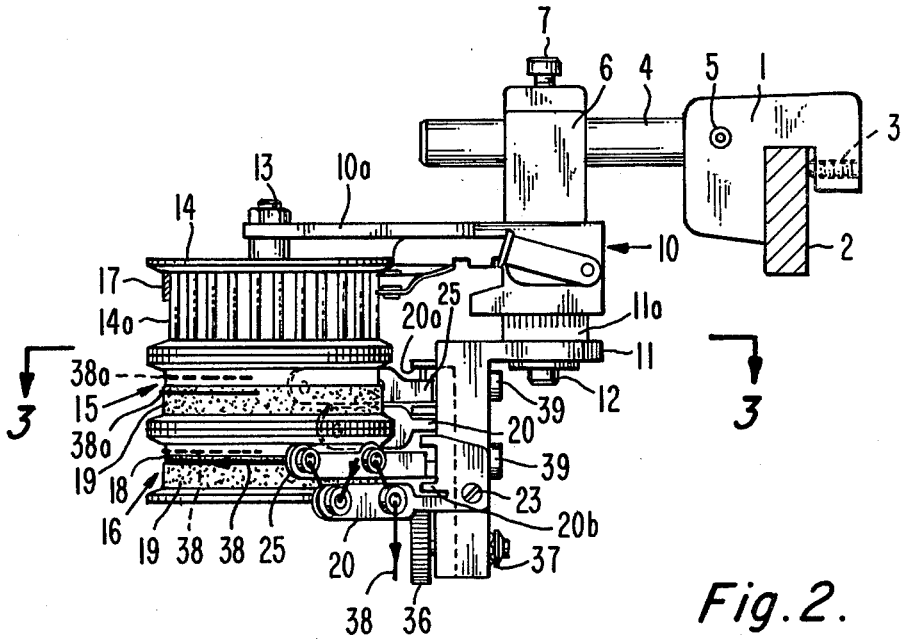

In the drawings:

FIG. 1 is a perspective view of the yarn feeding apparatus of the present invemtion showing yarn feeding wheels having feeding and non-feeding zones, fixed and movable yarn guiding eyelets to guide the yarn around the feeding and the non-feeding zones of the wheels in response to demand and lack of demand for yarn by the machine, and means to drive the wheels, FIG. 2 is a side elevational view of the apparatus shown in FIG. 1, FIG. 3 is a cross-sectional view of the apparatus shown in FIG. 2 as taken on line 3—3 thereof, FIG. 4 is a cross-sectional view of the apparatus shown in FIG. 3 as taken on line 4—4 thereof, FIG. 5 is a perspective view of a modified form of yarn feeding wheel, FIG. 6 is a cross-sectional view of the modification of FIG. 5 as taken on line 6—6 thereof, and FIG. 7 is a schematic view showing the relative positions of the fixed and of the movable yarn guiding eyelets to guide the yarn around the feeding and the non-feeding zones of the yarn feeding wheel.

While the improved yarn feeding apparatus of the present invention can be mounted upon a knitting machine in more than one way, it is shown in the drawings as being mounted upon a prior art type of yarn feeding device (which device is itself mounted upon the knitting machine) wherein an endless driven yarn feeding tape is trained over and drives each of a plurality of circularly spaced yarn feeding wheels and wherein yarns positioned between the tape and the wheels are driven thereby to be fed to the knitting machine. Such mounting of the present yarn feeding apparatus has the advantage that not only can it and the prior art yarn feeding device be used either together or independently of each other, but in addition thereto the tape and wheels of the prior art device can also be used to drive the wheels of the present yarn feeding apparatus. However, it will be understood that the yarn feeding wheels of the present apparatus can also be driven by other means.

The knitting machine has a holder 1 secured to a support ring 2 by a screw 3, FIGS. 1, 2, while a radially extending support arm 4 is secured in the holder by a screw 5. A radially movable block 6 is adjustably secured to the support arm by a screw 7. A prior art tape and wheel yarn feeding device, indicated generally at 10, is secured to the underside of block 6 by a screw 12 extending upwardly through a suitable aperture formed in the top of an inverted L-shaped frame member 11, through a spacer 11*a*, through the base of device 10, and into threaded engagement with block 6. Device 10 is provided with a centrally extending arm 10*a*, and with laterally extending side arms 10*b*, 10*c* having spaced pairs of yarn eyelets 9, 9 and 8, 8, respectively, formed therein. A rotatably journalled yarn feed wheel 14 is mounted upon arm 10*a* by a screw and nut 13 and a driving tape 17 is trained about the upper portion of the periphery of the wheel to rotate the same in the direction of the arrow in FIG. 1. The periphery of wheel 14 is provided with a circular series of spaced vertically extending pins 14*a* which offer little or no frictional resistance to a yarn passing thereover. When yarn is threaded through appropriate eyelets 8, 9 and is positioned between and in contact with moving tape 17 and with the periphery of wheel 14 driven thereby, the yarn is driven and is fed to the needles of the knitting machine. Yarn feeding may be discontinued by lowering arma 10*b*, 10*c* to accordingly lower the yarn to a position on the moving wheel below the moving tape. Eyelets 9, 9 and 8, 8 are positioned so that one or a pair of yarns can be fed by the device 10 to a machine.

The apparatus of the present invention includes a pair of yarn feed wheels 15, 16 axially aligned with and secured to the underside of wheel 14 to rotate therewith. Wheels 14, 15, 16 may be of basically similar construction. The periphery of each wheel 15, 16 is divided into adjacent upper and lower circumferentially extending zoned areas 18, 19, respectively. Zone 19 is encircled with suitable material, such as a rubber band or the like, which has a relatively high friction surface while zone 18 remains uncovered and has a relatively low friction surface.

Yarn guiding brackets are provided to enable yarns 38, 38*a* to interact individually with wheels 16, 15, respectively, to be fed thereby, and since such brackets and interaction are similar for each of the yarns, a description of one will suffice for both. A first angularly shaped fixed bracket 20 having horizontally spaced yarn eyelets 21, 22 affixed at one end thereof is affixed at its other end against a side face of frame 11 by a screw 23, with such other end of the bracket terminating in a vertically spaced pair of horizontally extending stops 20*a*, 20*b*. A second angularly shaped bracket 25 is pivotally mounted between its arms 28, 32 upon a pin 39 extending through frame 11. Arm 32 is provided with horizontally spaced eyelets 30, 31 affixed thereto and which are positioned generally parallel to, above, and between eyelets 21, 22 and wheel 16. Eyelets 30, 31, as well as bracket 25, move about the axis of pin 39 which is common thereto and which intersects with the vertical axis of the wheel. One end of a tension spring 29 disposed in a slot 34 in frame 11 is secured to arm 28 while its other end, via a cord 29*a*, is fastened to a rotatable pin 35 extending through the frame. A graduated adjusting disc 36 is secured to one end of pin 35 to turn the same to wind and unwind the cord thereon to adjust the spring tension. A circular spring washer 37 is operatively related to the other end of pin 35 and to frame 11 to hold the pin in adjusted position. Arm 32 of bracket 25 has limited rocking movement between upper and lower stops 20*a*, 20*b* with spring 29 urging arm 32 toward stop 20*a*.

The principle and the operation of the present invention will be explained with reference to the schematic view of FIG. 7, keeping in mind that yarn 38 is being fed to the needles of the knitting machine when it is in contact with zone 19 of rotating wheel 16, and that it is not being fed when it is in contact with zone 18 of the wheel. Yarn 38 extends from its source and is threaded through fixed eyelet 21, then upwardly through movable eyelet 30, then around the periphery of wheel 16, then through movable eyelet 31, then downwardly through fixed eyelet 22, and to the knitting machine. Eyelets 30, 31 are movable vertically in relation to stationary eyelets 21, 22 and to the axis of wheel 16, when there is no demand for yarn by the needles, there is minimal tension in the yarn and spring 29 raises arm 32 to stop 20*a* to raise eyelets 30, 31 to their dotted line upper position in relation to the wheel so that the yarn is raised to contact non-feeding zone 18 of wheel 16, as shown in dotted lines. When there is demand for the yarn by the needles, there is running tension in the yarn which acts upon arm 32 to overcome the tension of spring 29 to lower arm 32 to stop 20*b* to lower eyelets 30, 31 to their full line positions relative to the wheel so that the yarn is lowered to encircle feeding zone 19 of wheel 16, as shown in full lines. Yarn 38 is moved automatically between feeding and non-feeding zones 19, 18 on the wheel in response to the position of arm 32 and its eyelets 30, 31, relative to eyelets 21, 22, which in turn is determined by demand or non-demand for the yarn. Tension in spring 29 is adjusted so that it is overcome by tension in the running yarn then being fed to the needles with the result that arm 32 is lowered and its eyelets 30, 31 train the yarn around zone 19. Also, so that upon cessation of demand for yarn, spring 29 will raise arm 32 and its eyelets 30, 31 will train the yarn around zoner 18.

While it will be noted that the circumferential extend of yarn 38 in contact with the periphery of wheel may vary with the positioning of the yarn eyelets, in the present arrangement the eyelets are disposed so that the yarn is in contact with an arc of about two hundred and forty degrees of the periphery of the wheel, FIG. 3. This provides for excellent driving contact between the friction surface of zone 19 and yarn 38.

When the tension created in the activated yarn lowers arm 32, its spaced eyelets 30, 31 act upon the yarn at both ends of the portion of the yarn in contact with the wheel and this results in rapid shifting of the yarn from zone 18 to zone 19. Similarly, when yarn demand ceases and spring 29 raises arm 32, its spaced eyelets 30, 31 act at both ends of the encircled yarn to rapidly shift the yarn from zone 19 to zone 18. The shifting of yarn between zones 18, 19 is practically instantaneous and this results in better knitting conditions not only when the machine is making striped fabric but also when needle selected pattern fabric is being made.

The above description of the interaction between yarn 38, lower wheel 16 and related parts applies equally well to yarn 38*a*, upper level wheel 16 and related parts of the apparatus and to which like references have been made. While a pair of stacked wheels 15, 16 have been shown, a single one or more than two wheels may be used. It is within the scope of the invention to feed yarns between wheel 14 and tape 17 at the same time that yarns are fed by wheels 15, 16.

A modification of wheels 15, 16 is shown in FIGS. 5, 6 wherein the elastic band of zone 19, here designated 19*a*, is interlaced in and out, and between and around the pins of the circles of pins rather than encircling the periphery of all the pins. Wheels 15, 16 have pins 15*a*, 16*a*, respectively, and, in each wheel, the elastic band is placed in front of and in back of recurrent pairs of pins. Thus in zone 19 alternate pairs of pins 15*a* and 16*a* are covered by the elstic band while intervening pairs of yarns are not covered. The covered pins of zone 19 provide recurrent relatively high friction surfaces for feeding yarn while the uncovered pins of zones 19 and 18 make it easier and quicker for the yarn to shift between the zones.

I claim:

1. Self actuated positive yarn feeding apparatus to feed yarn to a circular knitting machine when a demand for the yarn is made by the machine and to cease feeding the yarn upon termination of the demand for the same by the machine, the yarn being under tension when being fed and being without tension when not fed, comprising a cylindrically shaped yarn feed wheel for rotation about a vertical axis, means to rotate the wheel, the periphery of the wheel providing first and second cylindrically shaped zones having relatively high and relatively low friction surfaces, respectively, fixed and movable yarn guiding eyelets, the eyelets and the wheel being disposed so that a yarn extending from its source is threaded through a fixed and a movable yarn eyelet, is then guided about the periphery of the wheel, is then threaded a movable and a fixed yarn eyelet, and then extends to the machine, the position of the yarn on the periphery of the wheel being shiftable between positions on the zones thereof, the arrangement being such that the yarn is fed by the wheel when it is on the periphery of the first zone and is not fed by the wheel when it is on the periphery of the second zone, and means actuated by the yarn in response to demand and non-demand of the yarn by the machine to shift the position of the yarn between its described positions on the periphery of the wheel, the means comprising a movable bracket having the movable eyelets spacedly disposed therein and being movable so that the eyelets are movable about a common axis which intersects with the vertical axis of the wheel, and with the fixed eyelets being spaced from the common axis.

* * * * *